US007321092B2

(12) United States Patent
Hauck

(10) Patent No.: US 7,321,092 B2
(45) Date of Patent: Jan. 22, 2008

(54) DUAL FOOT PEDALS FOR A BASS DRUM

(75) Inventor: Curt A. Hauck, 17976 Highway 8, Saint James, MO (US) 65559-8231

(73) Assignee: Curt A. Hauck, St. James, MO (US)

( * ) Notice: Subject to any disclaimer, the term of this patent is extended or adjusted under 35 U.S.C. 154(b) by 224 days.

(21) Appl. No.: 11/273,926

(22) Filed: Nov. 16, 2005

(65) Prior Publication Data

US 2007/0107582 A1 May 17, 2007

(51) Int. Cl.
*G10D 13/02* (2006.01)

(52) U.S. Cl. ..... 84/422.1; 84/422.1; 84/422.2

(58) Field of Classification Search ..... None
See application file for complete search history.

(56) References Cited

U.S. PATENT DOCUMENTS 4,186,644 A * 2/1980 Kurosaki ..... 84/422.1
4,819,536 A * 4/1989 Lombardi ..... 84/746
4,945,802 A * 8/1990 Ruprecht ..... 84/422.1
4,945,803 A * 8/1990 Norwood ..... 84/422.1
5,297,467 A * 3/1994 Hoshino ..... 84/422.1
5,317,946 A * 6/1994 Hoshino ..... 84/422.1
5,343,792 A * 9/1994 Liao ..... 84/422.1
5,388,494 A * 2/1995 Hoshino ..... 84/422.1
5,398,584 A * 3/1995 Liao ..... 84/422.1
5,427,010 A * 6/1995 Hoshino ..... 84/422.1
5,567,899 A * 10/1996 Hoshino ..... 84/422.1
5,591,929 A * 1/1997 Wellman ..... 84/422.1
5,627,332 A * 5/1997 Lombardi ..... 84/422.1
5,994,635 A * 11/1999 Hoshino ..... 84/422.1
5,998,718 A * 12/1999 Liao ..... 84/422.1
6,255,574 B1 * 7/2001 Sapienza ..... 84/422.1
2002/0121177 A1 * 9/2002 Sassmannshausen ..... 84/422.1
2002/0152872 A1 * 10/2002 O'Donnell ..... 84/422.1
2005/0124470 A1 * 6/2005 Schopf ..... 482/100
2007/0107582 A1 * 5/2007 Hauck ..... 84/422.1
2007/0113722 A1 * 5/2007 Chen ..... 84/422.1
2007/0131088 A1 * 6/2007 Hauck ..... 84/422.1

* cited by examiner

*Primary Examiner*—Lincoln Donovan
*Assistant Examiner*—Robert W. Horn

(57) ABSTRACT

A dual foot pedal system operates on a bass drum with a beat having a different rhythm. The first foot pedal operates on the drum by a direct transmission from the pedal to the surface of the drum. The second foot pedal has a mechanism thereon that changes the relative position of the travel between the cantilevered hammer heads to obtain a difference of a beat on the drum. The difference is achieved by a driven disc which is operated by the second foot pedal stepped upon by the individual drummer. There is a floating disc adjacent to the driven disc adjustably connected to the driven disc which changes the length of time of the second cantilevered hammer head to travel to an impact on the drum relative to the impact obtained by the first foot pedal.

8 Claims, 4 Drawing Sheets

DUAL FOOT PEDALS FOR A BASS DRUM

FIELD OF THE INVENTION

The invention pertains to percussion instruments, especially in the use of bass drums. Bass drums are activated by foot pedals which operate a hammer head that will hit the skin surface of the drum to create a sound.

BACKGROUND OF THE INVENTION

Drummers in a band are known to operate a foot pedal that will strike the skin of the bass drum to among other things mostly create the rhythm or the beat of the tune being played. The better the beat, the better the dancers can follow the tune being played. Percussionists are known to be quite creative in establishing quite some beats especially through the use of dual foot pedals. The dual foot pedals can be activated at the same to increase the level of the beat or they can be activated by the feet of the drummer with a split second time interval to create a different sound which can be quite interesting. Of course, this requires a sense of timing and a specific talent.

BRIEF DESCRIPTION OF THE INVENTION

The inventive concept has improved on the dual foot pedal bass drum percussion by making the two foot pedals adjustable relative to each other. In this manner, if both foot pedals are hit at the same time or simultaneously, the sounds emanating from the drum would have a split second delay from one to the other. The device is constructed in such a way that one of the pedals can be adjusted relative to the other in that the original distance of each of the hammer heads from the surface of the drum is different from each other relative to the drum and therefore the pedals have to travel a somewhat longer distance which results in a double beat of percussion.

DETAILED DESCRIPTION OF THE INVENTION

Figure 1:
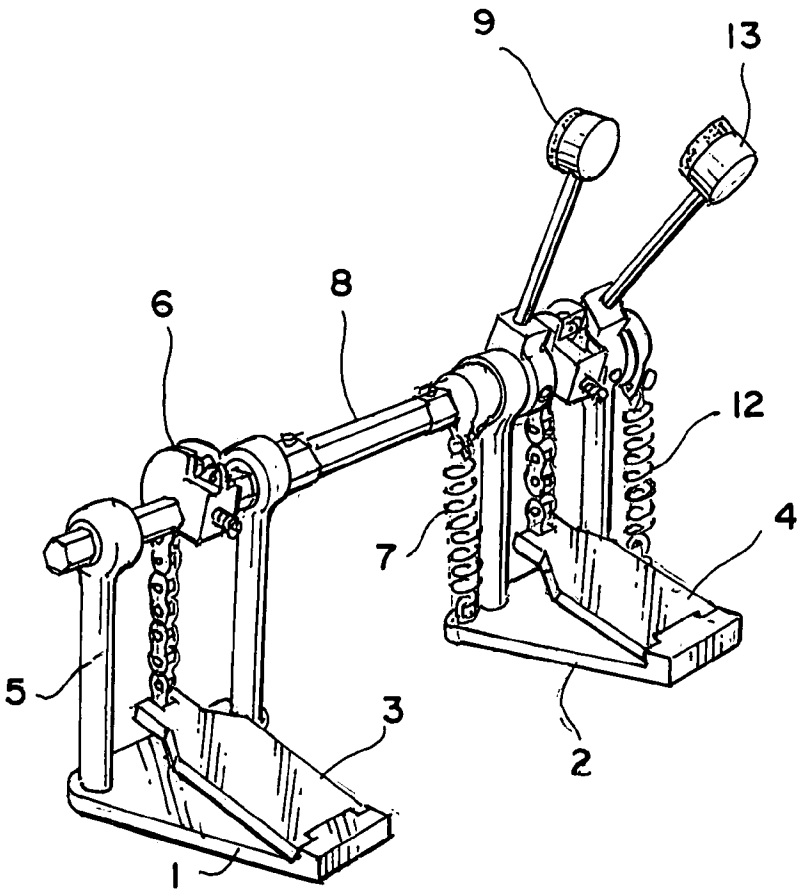
FIG. 1 (PRIOR ART)
FIG. 1 illustrates a prior art pedal assembly.

FIG. 1 illustrates the prior art device. It consists of two left and right standard supports 1 and 2 having upright stanchions thereon (not shown) to support a horizontal drive shaft D. On the standards there are two foot pedals 3 and 4 which are activated by the drummer. The left pedal 3 activates a chain drive 5 which is trained around a chain eccentric 6. The drive shaft D has a component thereon which tensions the tension spring 7 when the drive shaft D is turned because the foot pedal 3 was stepped upon by the drummer. The foot pedal 4 likewise will activate the chain drive 8 which in turn will activate the right drive eccentric 11. The tension spring 12 will return the foot pedal 4 to its original position when the foot pressure is released.

The drive shaft D has a left hammer head 9 mounted thereon which will hit the drum (not shown) when the foot pedal is stepped thereon. The standard also has a short shaft thereon which carries the right hammer head which will also hit the drum (not shown) when the right foot pedal 4 is stepped upon. When both pedals 3 and 4 are stepped upon simultaneously, both hammer heads 9 and 13 hit the drum at the same time. Of course, if the pedals 3 and 4 are stepped upon in a differing timing, the hammer heads 9 and 13 hit the drum at different times to thereby create a different beat. The inventive device creates a different beat even if both foot pedals are activated simultaneously as will be described below.

Figure 2:
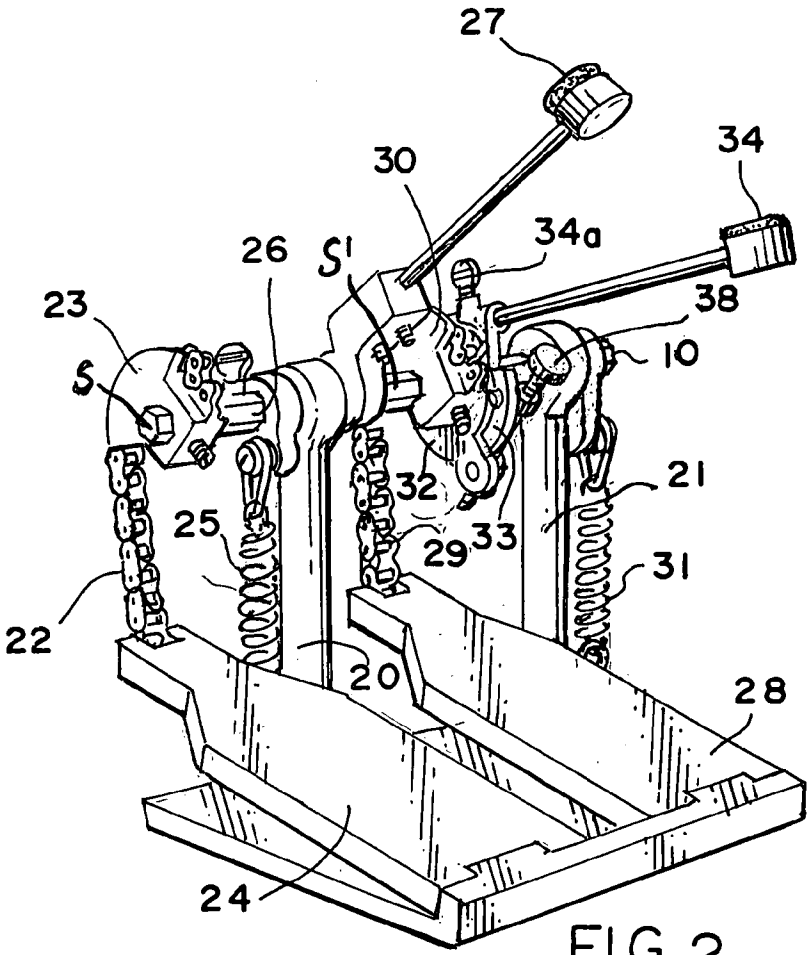
FIG. 2 shows how one pedal is adjustable relative to the other.

FIG. 2 shows the inventive device in its basic concept. There are two foot pedals side-by-side The foot pedals could be played one or both at the same time. One of the pedals could be adjusted very quickly to off set the timing of the beat the difference in the timing could be adjusted forward or backward. In FIG. 2 there is shown the basic support or stanchions 20 and 21 which support a horizontal shaft S. The left pedal 24 activates the chain drive 22 which in turn will turn the shaft S by way of the chain eccentric 23 which shaft S has the hammer head 27 mounted thereon for swinging movement. The return spring 25 returns the shaft S to a normal position when the foot pressure is released. This is a standard procedure known in the prior art and explained in FIG. 1. When the foot pedal 24 is stepped upon the hammer head will hit the surface of the drum without delay.

The right foot pedal 28 activates a chain eccentric (not shown) which in turn will activate a separate shaft S'. There is driven disc 32 mounted on the shaft S' and there is a floating disc 33 having the hammer head 34 mounted thereon. The floating disc 33 is connected to the driven disc 32 at varying and different locations so that the distance of the two hammer heads 27 and 34 between the surface of the drum and the heads is adjustable. That means, when the foot pedals 24 and 28 are stepped upon at the same time, the hammer heads hit the surface of the drum at different times because of the different distances the hammer heads 27 and 34 have to travel. This will result in two spaced apart beats. There are two different embodiments to accomplish these results which will be explained below.

Figure 3:
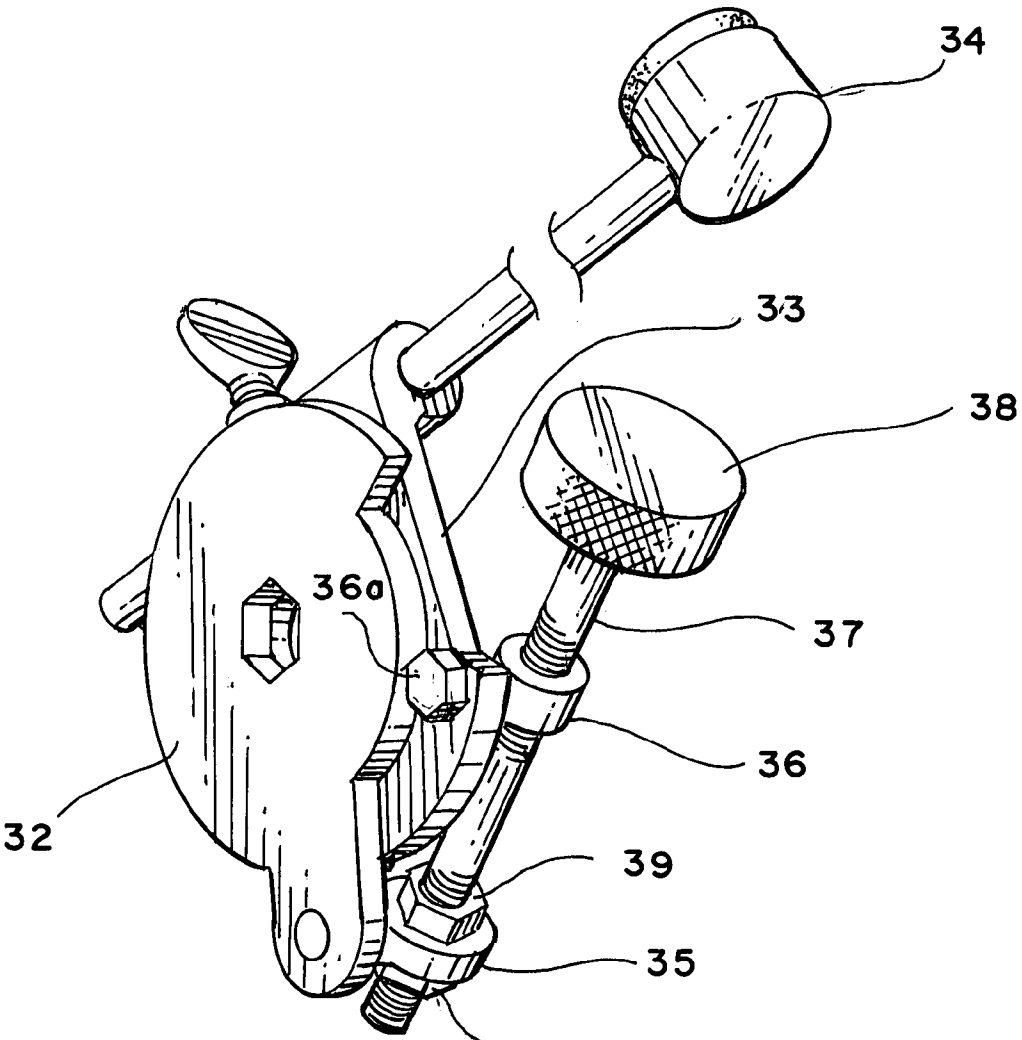
FIG. 3 illustrates a first embodiment of an adjustability between the pedals.
Figures 4, 5:
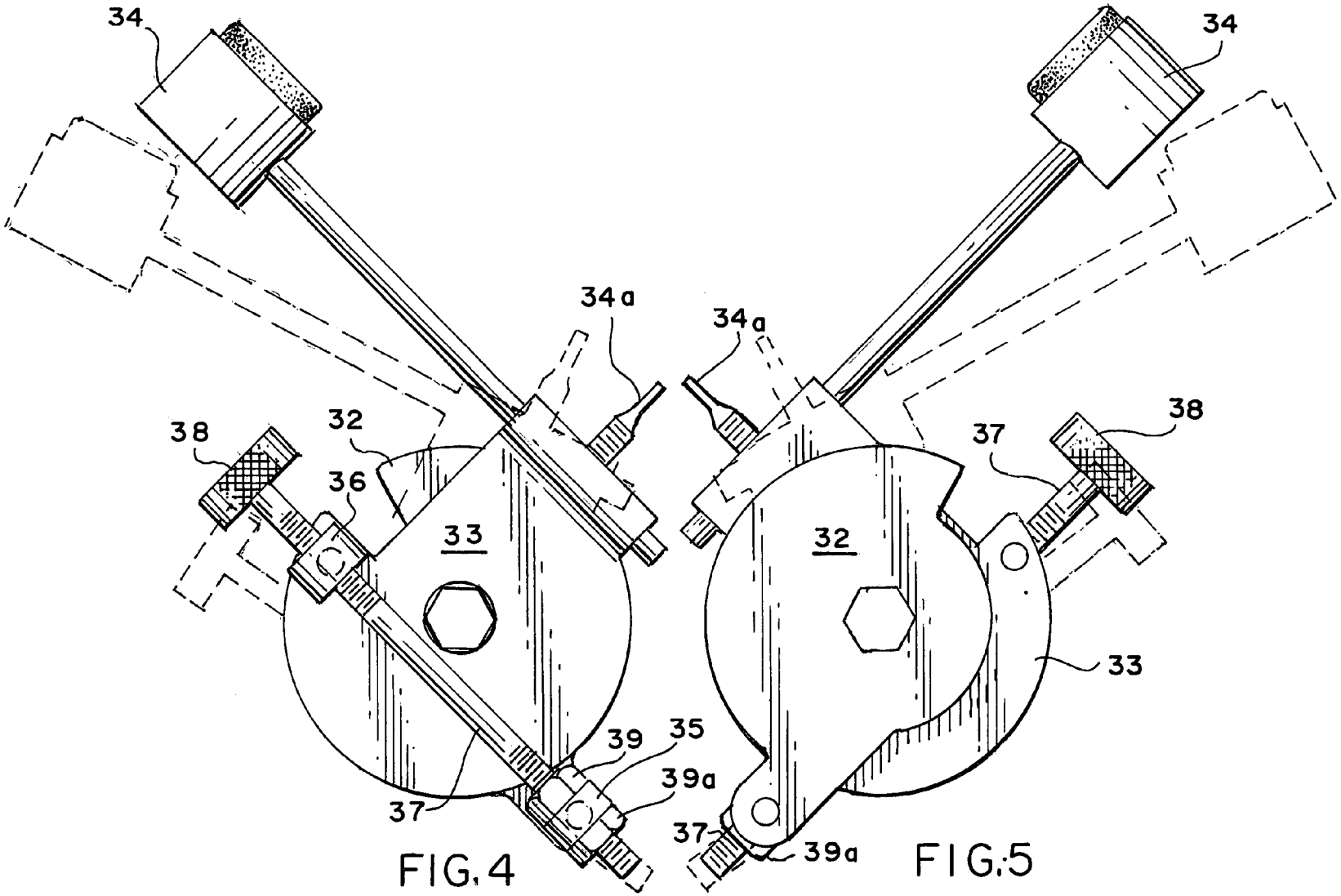
FIGS. 4 and 5 are a detailed view of the embodiment of FIG. 3

FIGS. 3 and 4 show the first embodiment wherein the two discs 32 and 33 are adjustable by way of a screw shaft 37. These FIGS. show the driven disc 32 which is mounted on the shaft S' (FIG. 2). The floating disc 33 has the hammer head 34 mounted thereon in a cantilevered fashion. The floating disc 33 also has a flange 36 attached thereto by way of screw head 36*a*. The driven disc 32 has a flange 35 attached thereto. Both flanges 35 and 36 are interconnected to each other by way of a screw shaft 37 which an adjusting head 38 thereon. Simply by turning the adjusting head 38 in one direction or the other, the relative position between the driven disc 32 and the floating disc 33 will be changed to thereby change the length of travel the hammer head has to undergo to reach the surface of the drum for an impact. This then changes the timing of impact between the regular hammer head 27 (FIG. 2) and the adjustable hammer head 34 for an interesting change in the rhythm of the drummer. The relative position between the driven disc and the floating disc can instantaneously be changed or can be locked into place by using the arresting nut 39 screwed against the flange 35 and the counter nut 39*a*.

Figure 7:
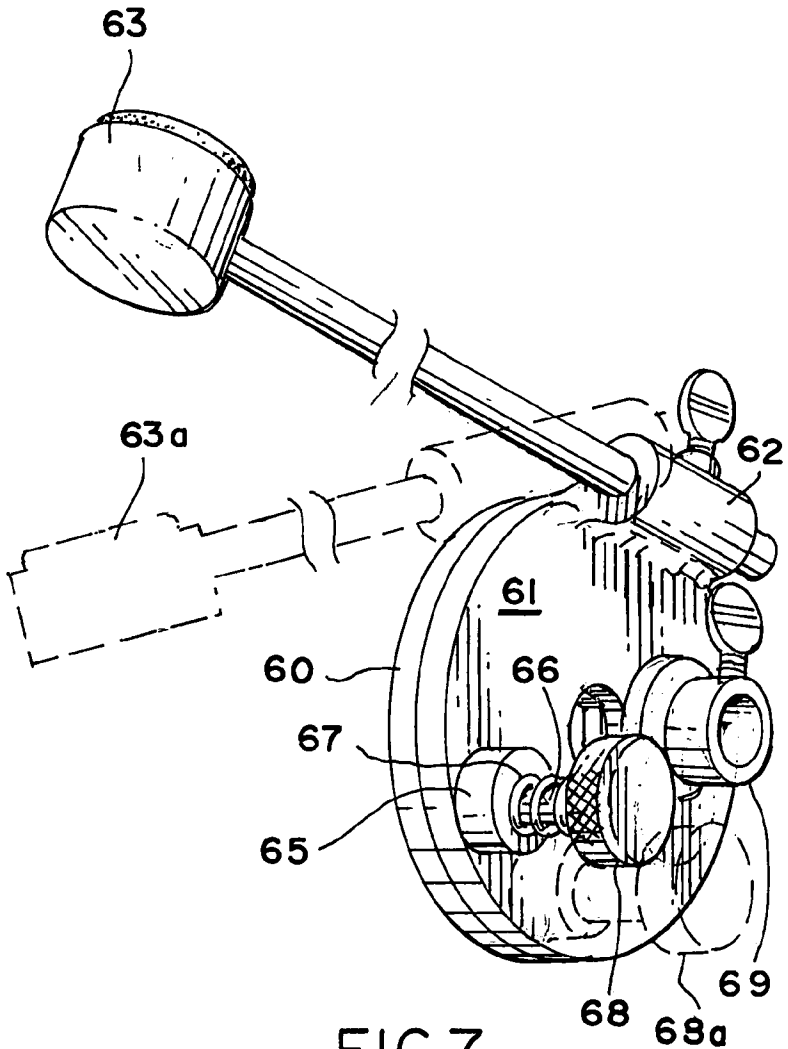
FIGS. 6 and 7 are two different views of a second embodiment of FIG. 2.
Figure 6:
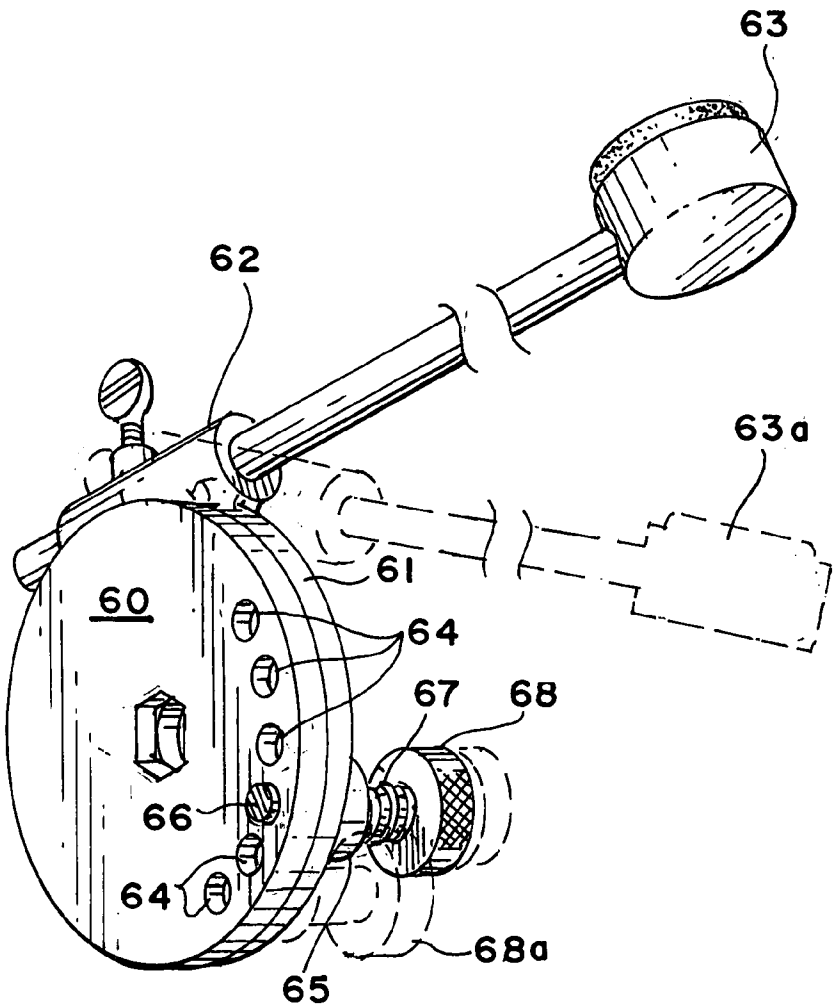

FIGS. 6 and 7 illustrate the second embodiment of the dual foot pedal system. In this embodiment there is a driven disc 60 and a floating disc 61. A flange 62 attaches the cantilevered hammer head 63 to the floating disc. Both discs are of a circular cross section but obviously could be of other shapes too. But a circular cross section lends itself best to accomplish the inventive concept. The floating disc 61 has collar 65 thereon which receives an adjusting pin 66 there through. The adjusting pin penetrates through the floating disc 61 and continues to penetrate through the driven disc 60. This then rigidities a connection between the two discs 60 and 61. The driven disc has a multiple of holes 64 therein which can be chosen by the drummer to desired and different locations. The adjusting pin has an adjusting head 68 which is pulled out so that the adjusting pin can be placed into the various openings or holes 64 to an adjusted position. The adjusting pin 66 is being surrounded by a tension spring 67. The bias of the tension spring is so arranged that the adjusting pin always remains in an adjusted position unless the pin 66 is pulled out by its head 68 against the bias of the spring 67 and placed into a different hole 64 once the discs 60 and 61 have been rotated relative to each other. The newly adjusted position can be seen in both FIGS. 6 and 7 by the phantom heads 68*a*. It can be seen that this second embodiment allows for an easy adjustment of the hammer head 63 relative to the hammer head 27 (FIG. 2) to create a different timing between the two hammer heads 27 (FIG. 2 and the hammer head 63 (FIGS. 6 and 7). The difference in timing results in both hammer heads hitting the surface of the bass drum at different times which results in an interesting rhythm of the tune being played. As previous explained, the adjustment can be forward or backward depending on the whims of the drummer.

What is claimed is:

1. A dual foot pedal system for a bass drum including two hammer heads hitting the surface of said drum at different times, said pedal system including two support stanchions and further including a first regular foot pedal having a first means thereon for hitting said drum surface with a first hammer head any time said pedal is stepped upon, said pedal system further including a second pedal having a second means thereon for hitting said surface of said drum at a time which is different from said first means, said second pedal means includes a driven disc and a floating disc having a hammer head thereon, means for changing the relative position between said driven disc and said floating disc to change the length of travel of said hammer disc on said floating disc relative said first hammer head, said first regular foot pedal and said second pedal are supported by said two stanchions in a side by side relationship.

2. The dual foot pedal system of claim 1, wherein said driven disc and said floating disc are adjustably interconnected by way of an adjusting pin which changes the relative position between said discs.

3. The dual foot pedal system of claim 2 including a first flange on said driven disc and a second flange on said floating disc, said adjusting pin interconnecting said first and second flanges.

4. The dual foot pedal system of claim 2, wherein said adjusting pin has a screw thread thereon.

5. The dual foot pedal system of claim 4 including an arresting nut on said adjusting pin prior to entering said second flange on said floating disc and a counter nut on said adjusting pin on the opposite side of said second flange.

6. The dual foot pedal system of claim 1, wherein said means for changing the relative position between said driven disc and said floating disc is a in passing through both of said discs at different locations.

7. The dual foot pedal system of claim 6, wherein said pin is movably mounted on said floating disc and wherein said driven disc has a multiple of holes to receive said pin in any selected location.

8. The dual foot pedal system of claim 6, wherein said pin is movable through said floating disc under a bias of a spring.

* * * * *